US009780454B2

(12) United States Patent
Asakawa

(10) Patent No.: US 9,780,454 B2
(45) Date of Patent: Oct. 3, 2017

(54) PATTERN ANTENNA

(71) Applicant: MegaChips Corporation, Osaka-shi (JP)

(72) Inventor: Koji Asakawa, Osaka (JP)

(73) Assignee: MegaChips Corporation, Osaka-shi (JP)

( * ) Notice: Subject to any disclaimer, the term of this patent is extended or adjusted under 35 U.S.C. 154(b) by 0 days.

(21) Appl. No.: 14/983,662

(22) Filed: Dec. 30, 2015

(65) Prior Publication Data

US 2016/0111791 A1 Apr. 21, 2016

Related U.S. Application Data

(63) Continuation of application No. PCT/JP2014/068677, filed on Jul. 14, 2014.

(30) Foreign Application Priority Data

Aug. 8, 2013 (JP) ..... 2013-164803

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/36* (2013.01); *H01Q 1/38* (2013.01); *H01Q 9/42* (2013.01)

(58) Field of Classification Search
CPC ..... H01Q 1/243; H01Q 9/0414; H01Q 9/42; H01Q 1/36; H01Q 1/38
See application file for complete search history.

(56) References Cited

U.S. PATENT DOCUMENTS 6,166,694 A * 12/2000 Ying ..... H01Q 1/243 343/700 MS
6,664,931 B1 * 12/2003 Nguyen ..... H01Q 1/243 343/700 MS
(Continued)

FOREIGN PATENT DOCUMENTS

JP 2004-242297 8/2004
JP 2005-110109 4/2005
(Continued)

OTHER PUBLICATIONS

English Translation of International Search Report issued Oct. 21, 2014 in PCT/JP2014/068677, filed Jul. 14, 2014.
(Continued)

*Primary Examiner* — Dieu H Duong
(74) *Attorney, Agent, or Firm* — Oblon, McClelland, Maier & Neustadt, L.L.P.

(57) ABSTRACT

A pattern antenna, with desired antenna characteristics, that is formed in a small area is provided. The pattern antenna includes a substrate, a ground portion formed on a first surface of the substrate, an antenna element portion, a short-circuiting portion, and a connecting portion. The antenna element portion is a conductor pattern including a conductor pattern in which a plurality of bent portions are formed. The conductor pattern is formed on the first surface of the substrate and, and is electrically connected to the grand portion. The short-circuiting portion includes a conductor pattern formed in a second surface, which is a different surface from the first surface. The conductor pattern is formed so as to at least partially overlap with the conductor pattern of the antenna element portion as viewed in planar view. The connecting portion is configured to electrically connect the conductor pattern of the antenna
(Continued)

element portion to the conductor pattern of the short-circuiting portion.

6 Claims, 11 Drawing Sheets

(51) Int. Cl.
*H01Q 9/42* (2006.01)
*H01Q 1/36* (2006.01)

(56) References Cited

U.S. PATENT DOCUMENTS 6,809,689 B1 * 10/2004 Chen ..... H01Q 9/0421 343/700 MS
7,218,282 B2 * 5/2007 Humpfer ..... H01Q 1/38 343/700 MS
2004/0263407 A1 12/2004 Inatsugu et al.
2012/0249386 A1 10/2012 Yanagi et al.
2012/0293392 A1 11/2012 Barratt et al.

FOREIGN PATENT DOCUMENTS

JP 2005-136784 5/2005
JP 2009-194783 8/2009
JP 2012-209752 10/2012
JP 2013-517727 5/2013

OTHER PUBLICATIONS

Japanese Office Action issued on Feb. 21, 2017 in Patent Application No. 2013-164803 (with English translation).

* cited by examiner

1000A

PATTERN ANTENNA

TECHNICAL FIELD

The present invention relates to a pattern antenna and an antenna device including a pattern antenna.

BACKGROUND ART

In recent years, many small-size devices with wireless communication functions have been developed. Demands for miniaturizing an antenna to be incorporated in such a small-size device is growing.

Conventionally, F-shaped pattern antennas are widely used as antennas to be incorporated in small-size devices. An F-shaped pattern antenna is configured by forming patterns on the surface of a printed circuit board such that an antenna element is F-shaped. This enables an antenna for high frequencies to be formed in a relatively small area on the printed circuit board.

Furthermore, techniques for improving antenna characteristics by changing the shape of an antenna element (pattern shape on the printed circuit board) in the F-shaped pattern antenna have been proposed (e.g., see Patent Literature 1 (JP 2009-194783A)).

DISCLOSURE OF INVENTION

Technical Problem

However, with the above conventional techniques, it may be difficult to achieve an antenna having a desired antenna characteristics. This will be described with reference to FIG. 10.

FIG. 10 is a diagram showing an example of a conventional F-shaped pattern antenna 900. As shown in FIG. 10, the F-shaped pattern antenna 900 includes a substrate 91, a ground plane 92 formed with a pattern on the substrate 91, and an antenna element 93 connected to the ground plane 92. Also, as shown in FIG. 10, F-shaped pattern antenna 900 includes feed points 94 and 95.

When the wavelength of the carrier wave used by the F-shaped pattern antenna 900 is λ, adjusting the length L91 of the antenna element 93 shown in FIG. 10 to a length corresponding to approximately λ/4 achieves preferable antenna characteristics (frequency characteristics). Furthermore, when the F-shaped pattern antenna 900 is adjusted such that its input impedance matches 50Ω, adjusting the distance from the feed point 94 to the GND plane (the distance corresponding to the portion indicated by the arrow M1 in FIG. 10) and the position of the feed point 94 (the length L92 shown in FIG. 10) enables the capacitance component and the inductance component to be adjusted, thus allowing the input impedance to be closer to 50Ω.

The F-shaped pattern antenna 900 shown in FIG. 10 is configured to include the antenna element 93 extending in the vertical direction in FIG. 10, and the length L91 needs to be set to the length corresponding to approximately λ/4. This makes it difficult for the pattern antenna to be configured in smaller area while maintaining the antenna performance of the F-shaped pattern antenna 900.

In view of this, to configure a pattern antenna in smaller area while maintaining the length of the antenna element, it is conceivable to form the antenna element portion with bent portions (to make the antenna element portion meander line shaped) like the pattern antenna 900A shown in FIG. 11.

However, in the pattern antenna 900A shown in FIG. 11, space required for the short-circuiting portion 931A that extends toward the feed point 94A from the meander line shaped portion of the antenna element portion 93A that is positioned closest to the GND plane 92A is narrow. In other words, as shown in FIG. 11, adjustable area for the position of the short-circuiting portion 931A is limited, thus making it difficult to adjust the position of the short-circuiting portion 931A, achieve desired antenna characteristics, and perform appropriate impedance matching in the pattern antenna 900A.

In view of the above problems, it is an object of the present invention to provide a pattern antenna, with desired antenna characteristics, that is formed in a small area.

Solution to Problem

To solve the above problem, a first aspect of the invention provides a pattern antenna including a substrate, a ground portion formed on a first surface of the substrate, an antenna element portion, a short-circuiting portion, and a connecting portion.

The antenna element portion is a conductor pattern including a conductor pattern in which a plurality of bent portions are formed. The conductor pattern is formed on the first surface of the substrate and, and is electrically connected to the grand portion.

The short-circuiting portion includes a conductor pattern formed in a second surface, which is a different surface from the first surface. The conductor pattern is formed so as to at least partially overlap with the conductor pattern of the antenna element portion as viewed in planar view.

The connecting portion is configured to electrically connect the conductor pattern of the antenna element portion to the conductor pattern of the short-circuiting portion.

In this pattern antenna, the conductor pattern of the antenna element portion is provided such that a plurality of bent portions are formed on the first surface of the substrate. This allows the antenna element portion to be provided in a small area while securing the necessary length of the conductor pattern for the pattern antenna. Also in this pattern antenna, the short-circuiting portion on the second surface of the substrate is electrically connected to the antenna element portion on the first surface of the substrate, thus allowing the short-circuiting portion with an enough size (length) to be formed in a small area. In this pattern antenna, adjusting an overlapped area between the conductor pattern of the short-circuiting portion and the conductor pattern of the antenna element portion as viewed in planar view enhances the capacitance (the capacitance component) of the input impedance.

This allows this pattern antenna to easily achieve a desired antenna characteristics, and also allows the input impedance of the pattern antenna to be easily adjusted. As a result, the circuit scale of a transmitting and receiving circuit required for impedance adjustment can be reduced. In other words, this pattern antenna reduces the area required for the pattern antenna to be formed, and easily achieves a desired antenna characteristics.

The substrate may be a multi-layer substrate, in which the first surface is formed in a layer and the second surface is formed in another layer.

A second aspect of the present invention provides the pattern antenna of the first aspect of the present invention in which the antenna element portion includes the conductor pattern formed in a meander line shape.

This pattern antenna includes the antenna element portion whose conductor pattern is formed in a meander line shape, thus allowing the antenna element portion to be formed in a small area.

A third aspect of the present invention provides the pattern antenna of the first or second aspect of the present invention further including a protruding portion electrically connected to the short-circuiting portion on the second surface of the substrate. The protruding portion includes a conductor pattern formed so as to at least partially overlap with the conductor pattern of the antenna element portion as viewed in planar view.

This structure of this pattern antenna lowers the antenna sensitivity to spurious signals (spurious electromagnetic waves). The antenna element portion with a complicated shape tends to have multi-band characteristics. Even in such a case, providing the protruding portion in this pattern antenna and adjusting the shape and position of the protruding portion lower the antenna sensitivity to spurious signals (spurious electromagnetic waves). Thus, this pattern antenna appropriately prevents its antenna characteristics from being multi-band characteristics.

Furthermore, in this pattern antenna, adjusting an overlapped area between the conductor pattern of the protruding portion and the conductor pattern of the antenna element portion as viewed in planar view enhances the capacitance (the capacitance component) of the input impedance. This easily achieves desired antenna characteristics in this pattern antenna.

A fourth aspect of the present invention provides the pattern antenna of the third aspect of the present invention in which the short-circuiting portion and the protruding portion are each formed in a rectangular shape.

The protruding portion is formed such that a distance from a center line in the longitudinal direction of the short-circuiting portion to the tip of the protruding portion as viewed in planar view is a length satisfying $\lambda/4\pm0.3\times(\lambda/4)$ (i.e., $\lambda/4-0.3\times(\lambda/4)\leq$(the length)$\leq\lambda/4+0.3\times(\lambda/4)$) where $\lambda$ is a wavelength of an electromagnetic wave to be eliminated in the pattern antenna.

Thus, in this pattern antenna, the phase difference between an electromagnetic wave (electromagnetic wave to be excluded) of a wavelength $\lambda$ that has been returned after totally reflecting at the tip of the protruding portion and an electromagnetic wave (electromagnetic wave to be excluded) of a wavelength $\lambda$ that propagates from the short-circuiting portion toward the feed point (a connection point, in the short-circuiting portion, for connecting an antenna transmitting and receiving unit) is approximately $\pi$, which is a reverse phase. Thus, the electromagnetic wave of a wavelength $\lambda$ that propagates directly toward the feed point and the electromagnetic wave of a wavelength $\lambda$ that propagates toward the feed point after totally reflecting at the protruding portion are canceled. This enables this pattern antenna to lower the antenna sensitivity to electromagnetic waves to be excluded.

A fifth aspect of the present invention provides the pattern antenna of the third aspect of the present invention in which the short-circuiting portion and the protruding portion are each formed in a rectangular shape.

The protruding portion is formed such that a distance from a center line in the longitudinal direction of the short-circuiting portion to the tip of the protruding portion as viewed in planar view is a length L1 satisfying $\lambda0=\lambda/\mathrm{sqrt}(\in r)$ and $L1=\lambda0/4\pm0.3\times(\lambda0/4)$ (i.e., $\lambda0/4-0.3\times(\lambda0/4)\leq L1\leq\lambda0/4\pm0.3\times(\lambda0/4)$) where $\lambda$ is a wavelength of an electromagnetic wave to be eliminated in the pattern antenna, $\in r$ is a specific dielectric constant of the substrate, and sqrt(x) is a function that returns the square root of x.

This structure of this pattern antenna lowers the antenna sensitivity to electromagnetic waves to be excluded, in consideration of the wavelength shortening effect.

The wavelength shortening effect is an effect in which the wavelength of a high-frequency signal passing through a conductor portion shortens depending on a specific dielectric constant of material located around the conductor portion through which the signal passes. The wavelength $\lambda0$ in consideration of the wavelength shortening effect is calculated as follows:

$$\lambda0=\lambda/\mathrm{sqrt}(\in r)$$

where $\in r$ is a specific dielectric constant of material located around the conductor portion through which the signal passes.

A sixth aspect of the present invention provides the pattern antenna of the third aspect of the present invention in which the short-circuiting portion and the protruding portion are each formed in a rectangular shape.

The protruding portion is formed such that a distance from a center line in the longitudinal direction of the short-circuiting portion to the tip of the protruding portion as viewed in planar view is a length L2 satisfying $\lambda0=\lambda/\mathrm{sqrt}(\in r)$ and $L2=Kc\times\lambda0/4\pm0.3\times Kc\times(\lambda0/4)$ (i.e., $Kc\times\lambda0/4-0.3\times Kc\times(\lambda0/4)\leq L2\leq Kc\times\lambda0/4+0.3\times Kc\times(\lambda0/4)$) where $\lambda$ is a wavelength of an electromagnetic wave to be eliminated in the pattern antenna, $\in r$ is a specific dielectric constant of the substrate, Kc ($0\leq Kc\leq1$) is a capacitance contribution rate caused by overlapping of the conductor pattern of the antenna element portion with the conductor pattern of the protruding portion as viewed in planar view, and sqrt(x) is a function that returns the square root of x.

This structure of this pattern antenna lowers the antenna sensitivity to electromagnetic waves to be excluded, in consideration of the wavelength shortening effect and the capacitance contribution rate Kc ($0\leq Kc\leq1$) caused by overlapping of the conductor pattern of the antenna element portion with the conductor pattern of the protruding portion as viewed in planar view.

Overlapping of the conductor pattern of the antenna element portion with the conductor pattern of the protruding portion as viewed in planar view enhances the capacitance component of the input impedance. Determining the length L2 using the above formulas in consideration of the capacitance contribution rate caused by such overlapping in this pattern antenna lowers the antenna sensitivity to electromagnetic waves to be excluded, and reduces the size of the protruding portion. This allows this pattern antenna to be formed in a smaller area, and appropriately lowers the antenna sensitivity to electromagnetic waves to be excluded in this pattern antenna.

A seventh aspect of the present invention provides the pattern antenna of one of the third to sixth aspects of the present invention in which the protruding portion includes a plurality of portions (a plurality of protrusions) formed on the second surface of the substrate, each of which does not overlap with the others.

Thus, the plurality of protrusions in this pattern antenna lowers the antenna sensitivity to electromagnetic waves with a plurality of spurious frequencies. In this pattern antenna, adjusting an overlapped area between the conductor pattern of the plurality of protrusions and the conductor pattern of the antenna element portion as viewed in planar view enhances the capacitance (the capacitance component).

Thus, this pattern antenna enables a desired antenna characteristics to be easily achieved.

Advantageous Effects

The present invention provides a pattern antenna, with desired antenna characteristics, that is formed in a small area.

DESCRIPTION OF THE PREFERRED EMBODIMENTS

First Embodiment

A first embodiment will now be described with reference to the drawings.

Figure 1:
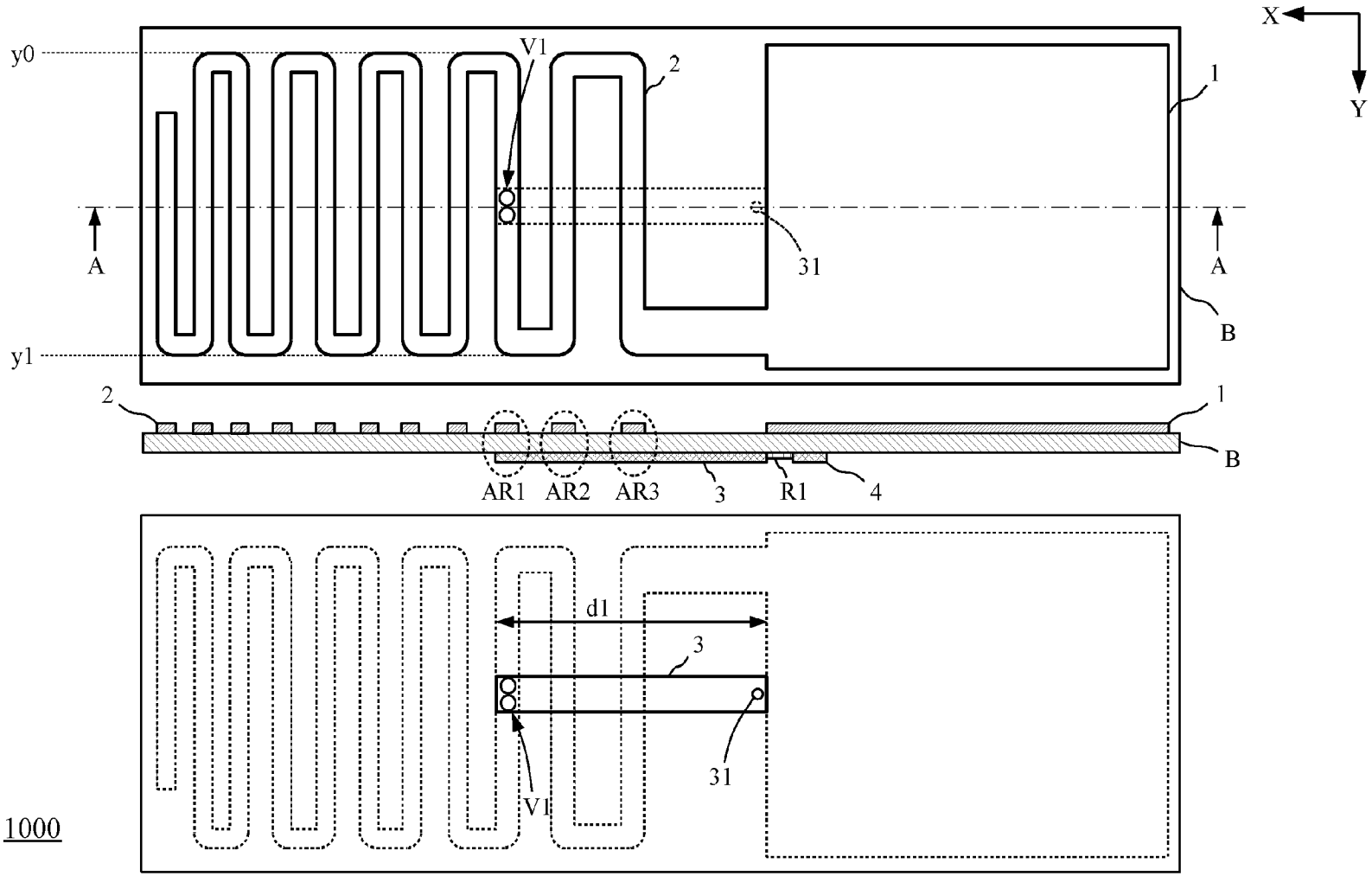
FIG. 1 is a schematic diagram of a pattern antenna 1000 according to a first embodiment.

FIG. 1 is a schematic diagram of a pattern antenna 1000 according to the first embodiment.

The upper portion of FIG. 1 is a plan view of the pattern antenna 1000 of the first embodiment; the middle portion of FIG. 1 is an A-A sectional view; and the lower portion of FIG. 1 is a bottom view of the pattern antenna 1000. The X-axis and Y-axis are set as shown in FIG. 1.

The pattern antenna 1000, as shown in FIG. 1, includes a substrate B, a ground portion 1 (GND portion) that is formed with a pattern on the first surface of the substrate B, and an antenna element portion 2, which is meander line shaped, connected to the ground portion 1. As shown in FIG. 1, the pattern antenna 1000 also includes a short-circuiting portion 3 on the second surface that is the back surface of the substrate B, which is disposed on the opposite side to the first surface.

The substrate B is, for example, a printed circuit board (e.g., a glass epoxy substrate). Patterns with conductors (e.g., copper foil) can be formed on the first surface and the second surface (surface different from the first surface) of the substrate B. For example, the substrate B is formed by a material (e.g., glass epoxy resin) with a specific dielectric constant of approximately 4.3. FIG. 1 illustrates a case where the first surface is the front surface of the substrate B and the second surface is the back surface of the substrate B (the surface opposite to the first surface); however, the present invention should not be limited to this structure. The substrate B may be a multi-layer substrate. The first surface may be formed on one of the multiple layers of the substrate B, and the second surface may be formed on another of the multiple layers of the substrate B. For ease of explanation, a case in FIG. 1 where the first surface is the front surface of the substrate B and the second surface is the back surface of the substrate B (the surface opposite to the first surface) will be described below.

The ground portion 1, which is a pattern formed on the first surface of the substrate B, is connected to the GND potential.

The antenna element portion 2 is a meander-shaped pattern formed on the first surface of the substrate B (a pattern in which bent portions are repeatedly formed). The antenna element portion 2, as shown in FIG. 1, is a pattern with bent portions repeatedly formed in a manner that the pattern having the bent portions is extending in the X-axis positive direction from the end of the ground portion 1. The pattern of the antenna element portion 2 is formed with a conductor (e.g., copper foil).

As shown in FIG. 1, through holes (via holes) V1 are formed on the pattern of the antenna element portion 2 to electrically connect the first surface to the second surface. Note that the through holes V1 may be disposed in the vicinity of the intersection of the pattern of the antenna element portion 2 and a straight line parallel to the X-axis, the straight line passing through the midpoint between the first end in the Y-axis direction of the meander line shaped pattern of the antenna element portion 2 (the end whose y-coordinate is "y0" as shown in FIG. 1) and the second end of the meander line shaped pattern of the antenna element portion 2 (the end whose y-coordinate is "y1" as shown in FIG. 1).

The short-circuiting portion 3 formed on the second surface of the substrate B is a pattern extending in the X-axis negative direction (extending toward the ground portion 1) from the position at which the through holes V1 are disposed on the second surface. The pattern of the short-circuiting portion 3 is formed with a conductor (e.g., copper foil). The short-circuiting portion 3 is electrically connected to the antenna element portion 2 on the first surface by filling the through holes V1 with conductive material such as solder.

Also, an antenna transmitting and receiving unit (e.g., antenna transmitting and receiving circuit) is provided between the ground portion 1 and the vicinity of an end of the short-circuiting portion 3, the end located on a side toward the ground portion 1, as viewed in planar view.

For example, in order for the pattern antenna 1000 to function as a transmitting antenna, an antenna transmitting unit (e.g., antenna transmitting circuit) is provided between the feed point 31 of the short-circuiting portion 3 and the ground portion 1. Alternatively, in order for the pattern antenna 1000 to function as a receiving antenna, an antenna receiving unit (e.g., antenna receiving circuit) is provided between the feed point 31 of the short-circuiting portion 3 and the ground portion 1, for example.

Incidentally, the feed point 31 is an example and is not limited to the above. For example, the feed point may be disposed at another position in the end portion of the short-circuiting portion 3 on a side toward the ground portion 1. Furthermore, the feed point is not limited to a point; the feed point may be formed with a line-shaped region or a planar region (e.g., all or part of a region at a side of the end of the short-circuiting portion 3 toward the ground portion 1).

Figure 11:
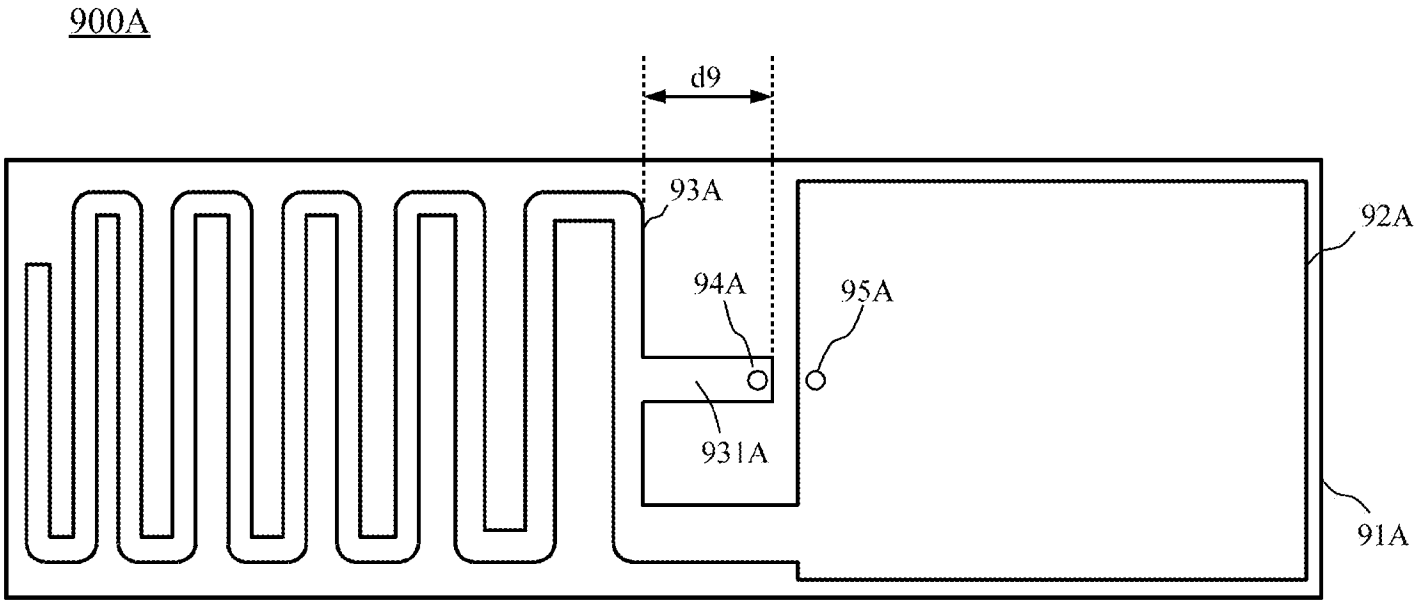
FIG. 11 BACKGROUND ART
FIG. 11 is a schematic diagram of a pattern antenna 900A (one example).

In the pattern antenna 1000 with the above-described structure, the short-circuiting portion 3 is formed on the second surface different from the first surface on which the pattern of the antenna element portion 2 is formed, thereby enabling the length of the short-circuiting portion 3 to be long. The length dl of the short-circuiting portion 3 in the pattern antenna 1000 as shown in FIG. 1 is much longer than the length d9 of the short-circuiting portion 931A in the pattern antenna, as shown in FIG. 11, in which the antenna element portion 93A and the short-circuiting portion 931A are both formed on the first surface.

Thus, the pattern antenna 1000 achieves improved antenna characteristics. In other words, in the pattern antenna 1000, the antenna element portion 2 on the first surface and the short-circuiting portion 3 on the second surface are disposed in a manner that the substrate B (e.g., a substrate with a relative permittivity of approximately 4.3) is sandwiched between the antenna element portion 2 and the short-circuiting portion 3, and a part of the antenna element portion 2 on the first surface overlaps with a part of the short-circuiting portion 3 on the second surface as viewed in planar view, thus producing capacitive coupling. More specifically, in the areas AR1, AR2 and AR3 in the A-A sectional view of FIG. 1 (the middle portion of FIG. 1), the conductor pattern of the antenna element portion 2 and the conductor pattern of the short-circuiting portion 3 are disposed in a manner that the substrate B is sandwiched between the antenna element portion 2 and the short-circuiting portion 3. Thus, the above-described structure in the areas AR1, AR2 and AR3 can be considered to be equivalent to a structure with capacitors disposed in parallel between the antenna element portion 2 and the ground portion 1. Thus, in the pattern antenna 1000, forming the short-circuiting portion 3 as shown in FIG. 1 produces capacitive coupling, thereby improving the antenna characteristics. Furthermore, in the pattern antenna 1000, adjusting the width of the short-circuiting portion 3 enables the strength of capacitive coupling to be changed, thus allowing desired antenna characteristics to be achieved easily. Furthermore, the pattern antenna 1000 has the short-circuiting portion 3 formed on the second surface different from the first surface, thus reducing the area required to form the short-circuiting portion. This enables the pattern antenna 1000 achieving desired antenna characteristics to be formed in a small area.

To improve antenna characteristics or perform impedance adjustment, conventional techniques need to additionally provide an LC circuit. In contrast, in the pattern antenna 1000, forming the short-circuiting portion 3 as shown in FIG. 1 produces capacitive coupling. This eliminates the need for an LC circuit or other circuits conventionally required to achieve desired characteristics or perform impedance adjustment, or reduces the circuit scale of such circuits. In other words, the pattern antenna 1000 achieves desired antenna characteristics and appropriately performs impedance adjustment, reducing the circuit scale of antenna circuits connected to the pattern antenna 1000.

Impedance Adjustment

Next, impedance adjustment (target impedance is assumed to be set to 50Ω) in the pattern antenna 1000 of the first embodiment will be described below.

Figure 2:
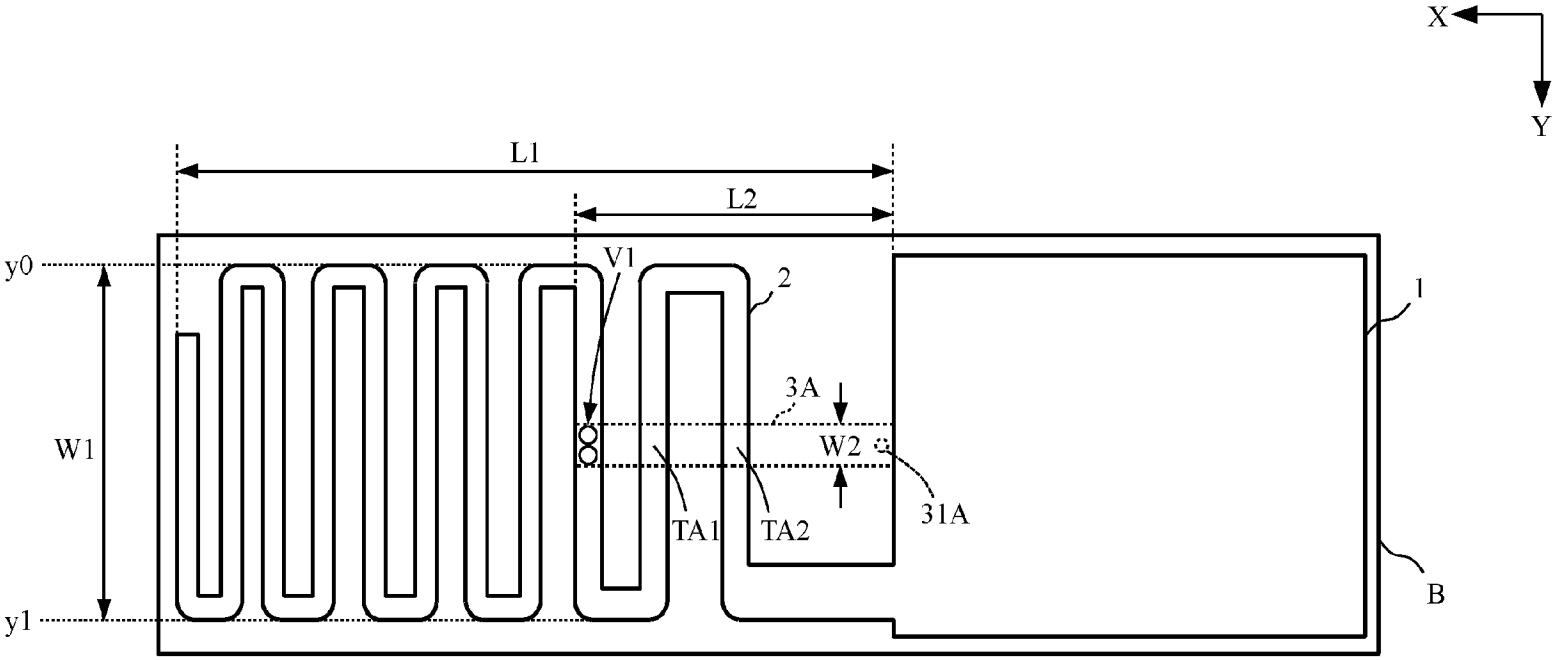
FIG. 2 is a plan view of a pattern antenna 1000A, which is an example of a pattern antenna according to the first embodiment.

FIG. 2 is a plan view (a figure similar to the upper portion of FIG. 1) of a pattern antenna 1000A, which is an example of a pattern antenna according to the first embodiment. In the pattern antenna 1000A in FIG. 2, the longitudinal length L1 (the length indicated as L1 in FIG. 2) of the antenna element portion 2 is 33.4 mm; the width W1 (the length indicated as W1 in FIG. 2) of the antenna element portion 2 is 15.8 mm; the longitudinal length L2 (the length indicated as L2 in FIG. 2) of the short-circuiting portion 3A is 14.7 mm; and the width W2 (the length indicated as W2 in FIG. 2) of the short-circuiting portion 3A is 1.85 mm.

Figure 3:
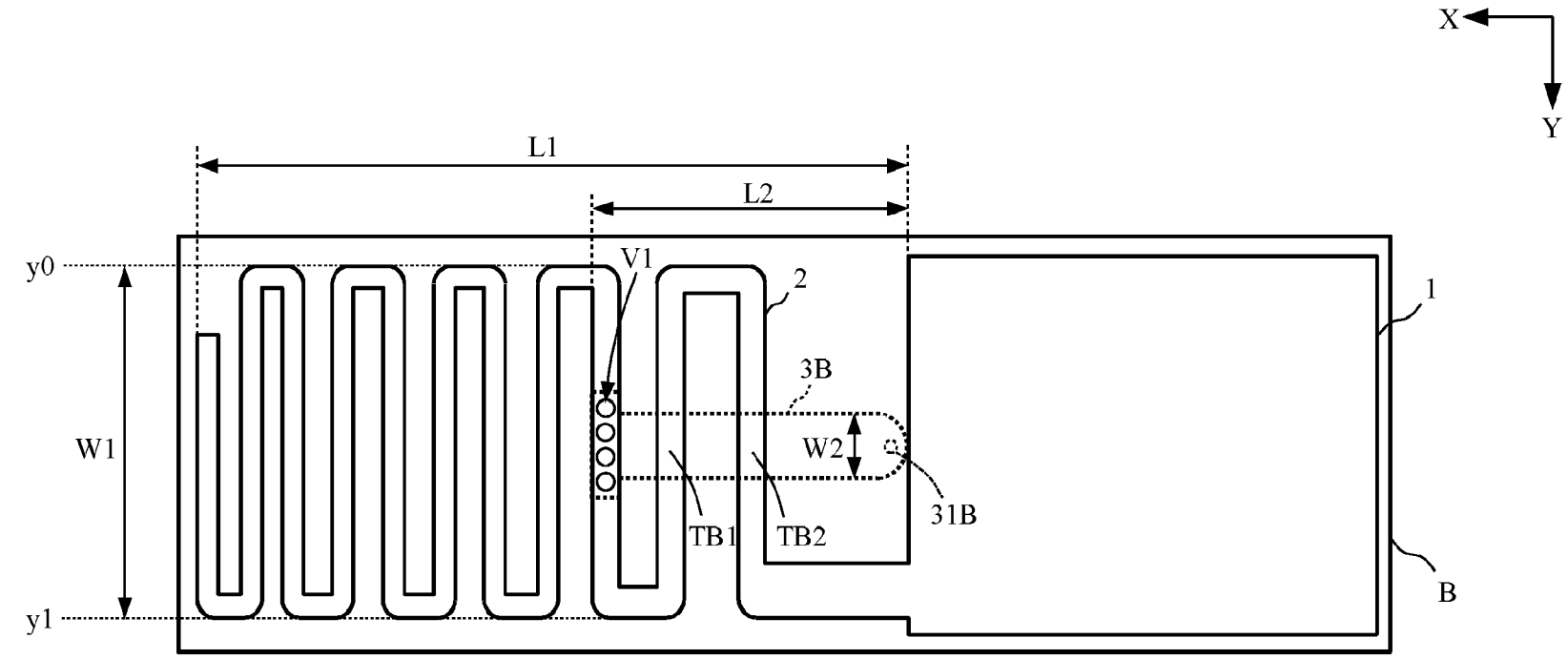
FIG. 3 is a plan view of a pattern antenna 1000B, which is an example of a pattern antenna according to the first embodiment.

FIG. 3 is a plan view (a figure similar to the upper portion of FIG. 1) of a pattern antenna 1000B, which is an example of a pattern antenna according to the first embodiment. In the pattern antenna 1000B in FIG. 3, the longitudinal length L1 (the length indicated as L1 in FIG. 2) of the antenna element portion 2 is 33.4 mm, which is the same length as that in FIG. 2, and the width W1 (the length indicated as W1 in FIG. 2) of the antenna element portion 2 is 15.8 mm, which is the same length as that in FIG. 2. The longitudinal length L2 (the length indicated as L2 in FIG. 2) of the short-circuiting portion 3B is 14.7 mm, which is the same length as that in FIG. 2, and the width W2 (the length indicated as W2 in FIG. 2) of the short-circuiting portion 3B is 2.92 mm. Note that in FIG. 3, the end, toward the ground portion 1, of the short-circuiting portion 3B of the pattern antenna 1000B is arc-shaped as viewed in planar view; however, the present invention should not be limited to this structure. The short-circuiting portion 3 may be rectangular shaped as viewed in planar view.

Figure 4:
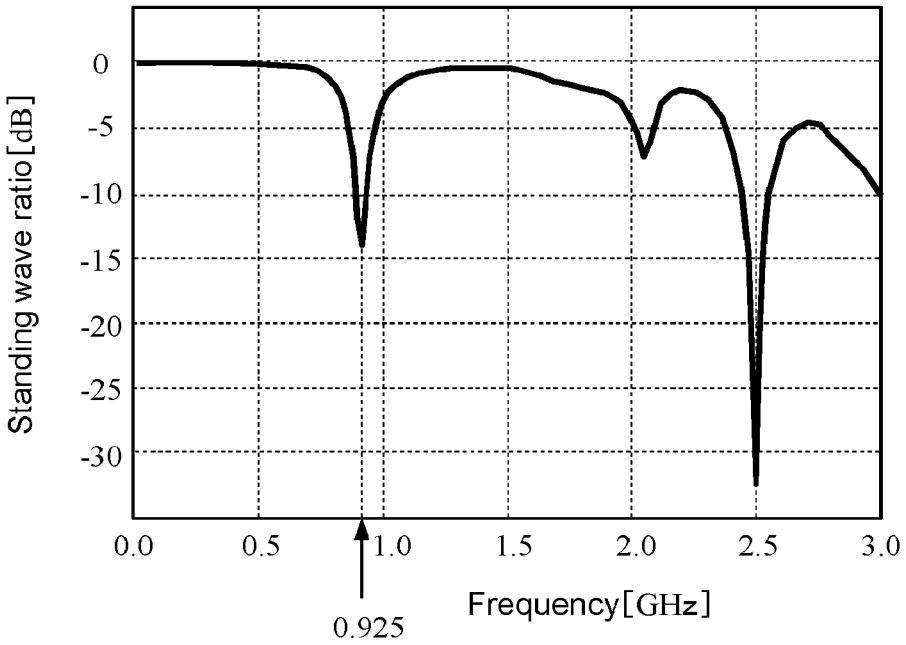
FIG. 4 is a diagram showing the frequency-standing wave ratio characteristics of the pattern antenna 1000A and the Smith chart of input impedance of the pattern antenna 1000A.
Figure 4:
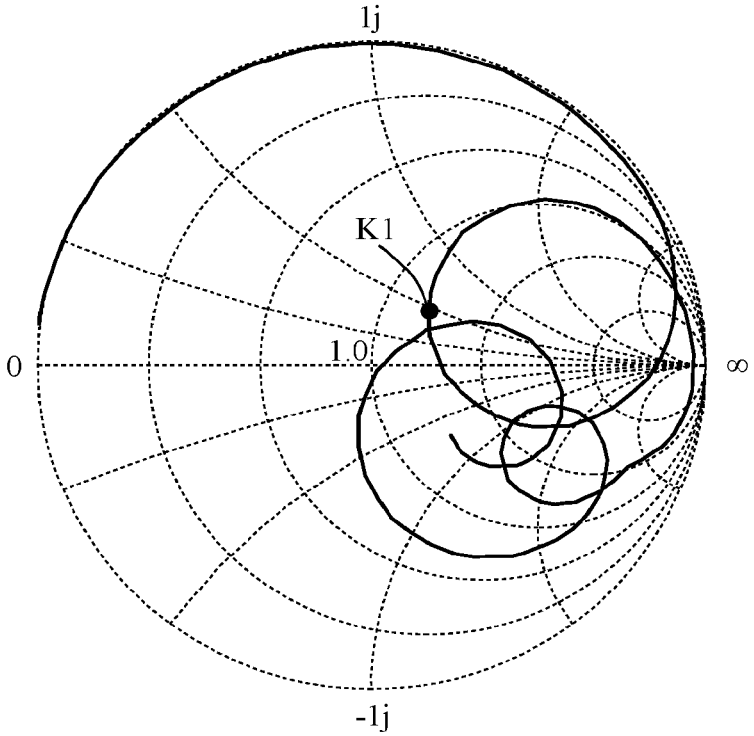

FIG. 4 is a diagram showing the frequency-standing wave ratio characteristics of the pattern antenna 1000A (the upper portion of FIG. 4) and the Smith chart of input impedance of the pattern antenna 1000A (the lower portion of FIG. 4).

Figure 5:
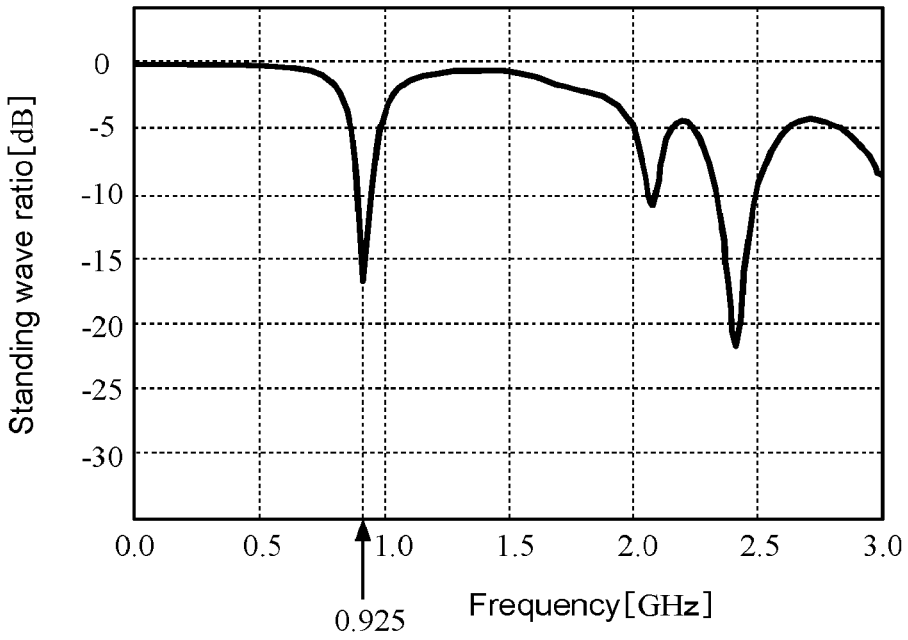
FIG. 5 is a diagram showing the frequency-standing wave ratio characteristics of the pattern antenna 1000B and the Smith chart of input impedance of the pattern antenna 1000B.
Figure 5:
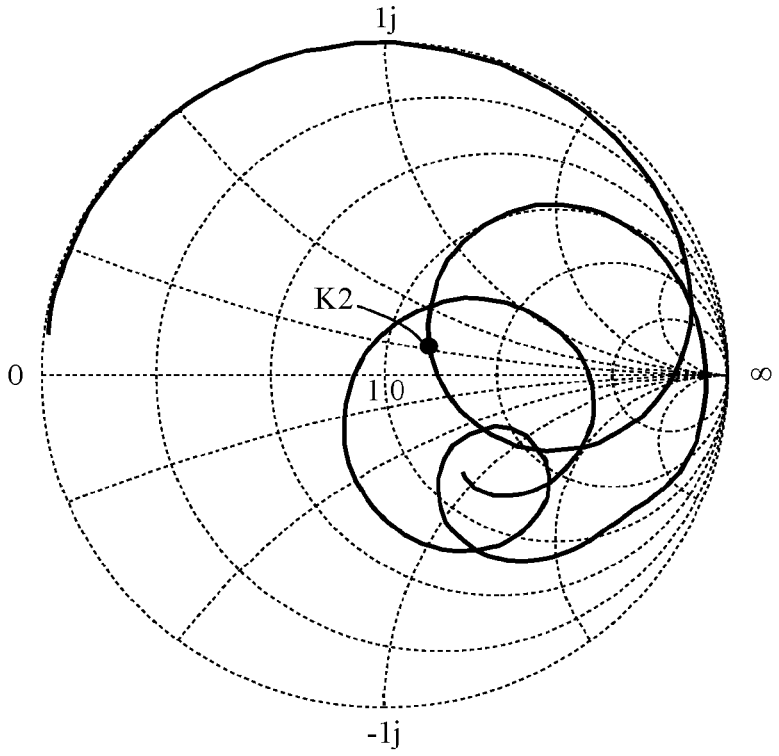

FIG. 5 is a diagram showing the frequency-standing wave ratio characteristics of the pattern antenna 1000B (the upper portion of FIG. 5) and the Smith chart of input impedance of the pattern antenna 1000B (the lower portion of FIG. 5).

It should be noted that in the following example, a case where the frequency of a signal (signal (electromagnetic waves) to be transmitted and received by the antenna pattern) used in the pattern antenna 1000A and 1000B is 925 MHz will be described below.

As shown in the diagram showing the frequency-standing wave ratio characteristics in FIG. 4 (the upper portion of FIG. 4), the pattern antenna 1000A has a frequency-standing wave ratio of −12.4 dB at 925 MHz.

Point K1 depicted in the Smith chart of the input impedance in FIG. 4 (the lower portion of FIG. 4) indicates the input impedance of the pattern antenna 1000A at 925 MHz. More specifically, the input impedance Z of the pattern antenna 1000A at 925 MHz is expressed in complex representation as follows:

$$Z=64.9+j\times 24.1$$

where "j" is the imaginary unit. The input impedance of the pattern antenna 1000A (the absolute value of Z) is 69.1Ω.

In the pattern antenna 1000A, for example, a circuit for impedance matching is provided between the feed point 31A of the short-circuiting portion 3A and the ground portion 1, and is adjusted such that the impedance Z=64.9+j×24.1 is closer to 50Ω (that is, Z=50) at 925 MHz, thereby enabling the input impedance of the pattern antenna 1000A to be closer to 50Ω.

As shown in the diagram showing the frequency-standing wave ratio characteristics in FIG. 5 (the upper portion of FIG. 5), the pattern antenna 1000B has a frequency-standing wave ratio of −15.7 dB at 925 MHz.

Point K2 depicted in the Smith chart of the input impedance in FIG. 5 (the lower portion of FIG. 5) indicates the input impedance of the pattern antenna 1000B at 925 MHz. More specifically, the input impedance Z of the pattern antenna 1000B at 925 MHz is expressed in complex representation as follows:

$$Z=63.5+j\times 12.9$$

where "j" is the imaginary unit. The input impedance of the pattern antenna 1000B (the absolute value of Z) is 64.9Ω.

In the pattern antenna 1000B, for example, a circuit for impedance matching is provided between the feed point 31B of the short-circuiting portion 3B and the ground portion 1, and is adjusted such that the impedance Z=63.5+j×12.9 is closer to 50Ω (that is, Z=50) at 925 MHz, thereby enabling the input impedance of the pattern antenna 1000B to be closer to 50Ω.

As shown in FIGS. 2 and 3, the width W2 of the short-circuiting portion 3B of the pattern antenna 1000B is wider than the width of the short-circuiting portion 3A of the pattern antenna 1000A. Thus, the pattern antenna 1000B has a larger area (e.g., the areas TB1 and TB2 in FIG. 3) where the short-circuiting portion 3B overlaps with the pattern of the antenna element portion 2 than an area (e.g., the areas TA1 and TA2 in FIG. 2) where the short-circuiting portion 3A overlaps with the pattern of the antenna element portion 2 of the pattern antenna 1000A, as viewed in planar view. As a result, the pattern antenna 1000B has a larger capacitance value inserted in parallel between the feed point 31B of the short-circuiting portion 3B and the ground portion 1 than that in the pattern antenna 1000A. More specifically, the input impedance, at a frequency of 925 MHz, of the pattern antenna 1000A is expressed as Z=64.9+j×24.1, whereas the input impedance of the pattern antenna 1000B is expressed as Z=63.5+j×12.9; that is, the capacitance is enhanced in the pattern antenna 1000B, thereby allowing the input impedance of the pattern antenna 1000B to be closer to the target input impedance of 50Ω.

As shown in FIGS. 4 and 5, the pattern antenna 1000B has a frequency-standing wave ratio of −15.7 dB at 925 MHz, which is improved by 3.3 dB as compared with the frequency-standing wave ratio of −12.4 dB at 925 MHz of the pattern antenna 1000A.

As described above, the pattern antenna of the present invention can easily adjust antenna frequency characteristics and input impedance characteristics to achieve desired characteristics by simply adjusting the width of the short-circuiting portion of the pattern antenna.

As a result, the pattern antenna of the present invention achieves desired antenna characteristics and appropriately performs impedance adjustment, reducing the circuit scale of an antenna circuit connected to the pattern antenna.

To adjust input impedance of the pattern antenna 1000, the specific dielectric constant between the first surfaces of the substrate B (the surface on which the ground portion 1 and the antenna element portion 2 are formed) and the second surface of the substrate B (the surface on which the short-circuiting portion 3 is formed) may be adjusted to be closer to a predetermined value, and furthermore the positional relationship, shapes as viewed in planar view, or the like of the antenna element portion 2 and the short-circuiting portion 3 may be adjusted in a manner similar to the above.

Second Embodiment

Next, a second embodiment will be described with reference to the drawings.

The components in the present embodiment that are the same as the components in the first embodiment are given the same reference numerals as those components, and will not be described in detail.

Figure 6:
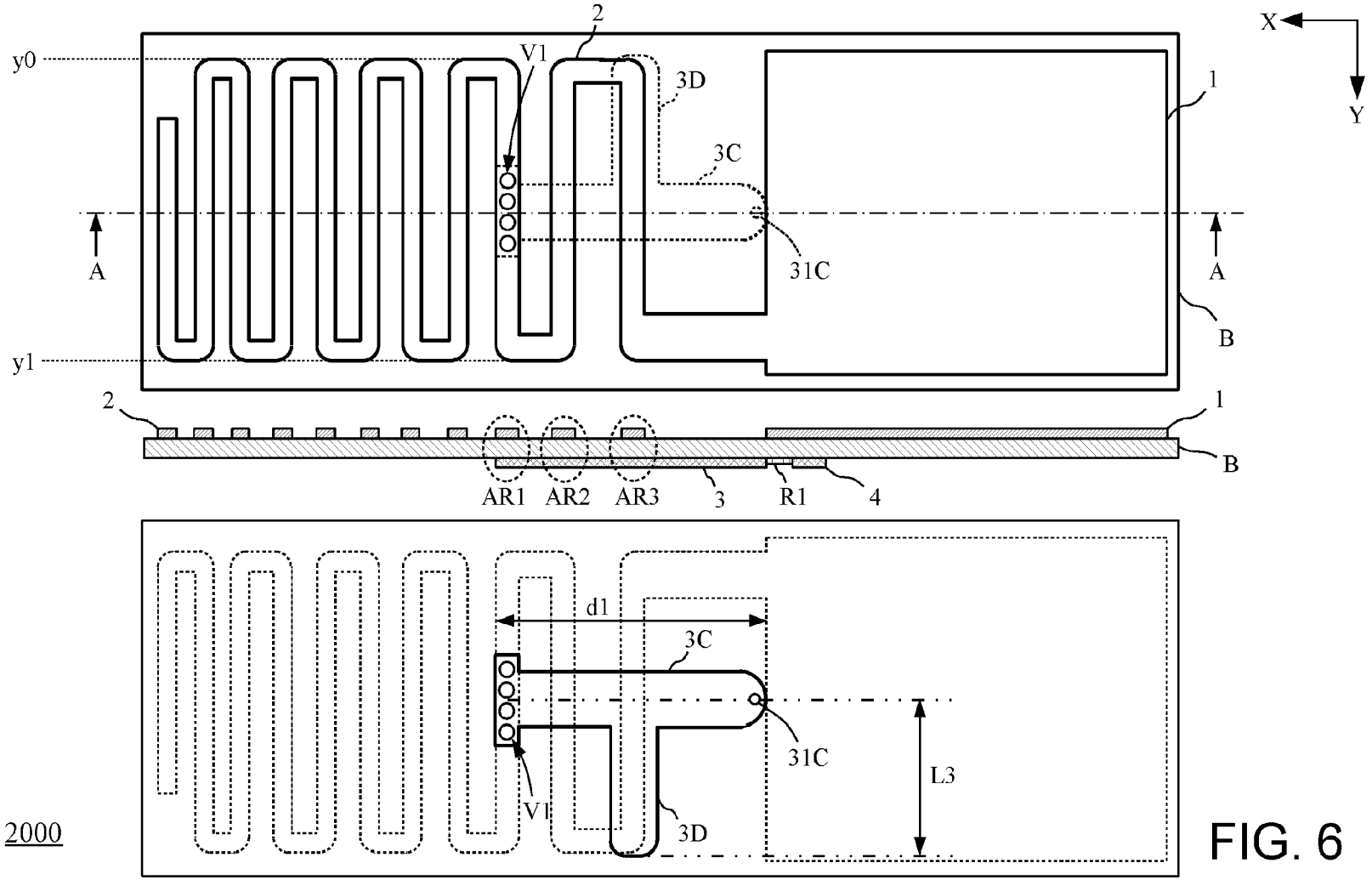
FIG. 6 is a schematic diagram of a pattern antenna 2000 according to a second embodiment.

FIG. 6 is a schematic diagram of a pattern antenna 2000 according to the second embodiment.

The upper portion of FIG. 6 is a plan view of the pattern antenna 2000 of the second embodiment; the middle portion of FIG. 6 is an A-A sectional view; and the lower portion of FIG. 6 is a bottom view of the pattern antenna 2000. The X-axis and Y-axis are set as shown in FIG. 6.

The pattern antenna 2000, as shown in FIG. 6, includes a substrate B, a ground portion 1 (GND portion) that is formed with a pattern on the first surface of the substrate B, and an antenna element portion 2, which is meander line shaped, connected to the ground portion 1. As shown in FIG. 6, the pattern antenna 2000 includes a short-circuiting portion 3C and a protruding portion 3D extending in the Y-axis direction from the short-circuiting portion 3C on the second surface, which is disposed on the opposite side to the first surface.

The protruding portion 3D, as shown in FIG. 6, is formed so as to have the length L3 in the Y-axis direction from a substantially central position in the width direction (Y-axis direction) of the short-circuiting portion 3C. The length L3 may be, for example, substantially identical to the length of λ/4, where the wavelength corresponding to a frequency that a signal to be eliminated (a signal that the pattern antenna preferably prevents from transmitting or receiving) has is λ, The protruding portion 3D, as shown in FIG. 6, is formed so as to overlap with the pattern of the antenna element portion 2 as viewed in planar view. Thus, the structure in which the pattern of the short-circuiting portion 3C overlaps with the pattern of the antenna element portion 2 as viewed in planar view is considered to be equivalent to a structure with capacitors disposed in parallel between the feed point 31C of the short-circuiting portion 3C and the ground portion 1, thereby enhancing the capacitance in the pattern antenna 2000.

Note that the length L3, as shown in FIG. 6, of the protruding portion 3D may be determined as follows.

The length L3 may be set to be equal to the length L3A satisfying the following formulas:

$$\lambda 0=\lambda/\mathrm{sqrt}(\in r)$$

$$L3A=\lambda 0/4\pm 0.3\times(\lambda 0/4)$$

$$(\lambda 0/4-0.3\times(\lambda 0/4)\leq L3A\leq\lambda 0/4+0.3\times(\lambda 0/4))$$

where sqrt(x) is a function that returns the square root of x and ∈r is a specific dielectric constant of the substrate B.

Alternatively, the length L3 may be set to be equal to the length L3B satisfying the following formulas:

$$\lambda 0=\lambda/\mathrm{sqrt}(\in r)$$

$$L3B=Kc\times\lambda 0/4\pm 0.3\times Kc\times(\lambda 0/4)$$

$$(Kc\times\lambda 0/4-0.3\times Kc\times(\lambda 0/4)\leq L3B\leq Kc\times\lambda 0/4+0.3\times Kc\times(\lambda 0/4))$$

where sqrt(x) is a function that returns the square root of x and Kc ($0 \leq Kc \leq 1$) is a capacitance contribution rate caused by overlapping of the conductor pattern of the antenna element portion 2 with the conductor pattern of the protruding portion 3D as viewed in planar view.

For example, when the size of the pattern antenna 2000 is the same as that of the pattern antenna 1000B shown in FIG. 3, the length L3B is calculated as follows:

$$\begin{aligned}\lambda 0 &= \lambda / sqrt(\varepsilon r)\\ &= 0.03 / sqrt(4.3)\\ &\approx 57.97 \text{ [mm]}\end{aligned}$$

$$\begin{aligned}L3B &= Kc \times \lambda 0 / 4\\ &= 0.55 \times \lambda 0 / 4\\ &\approx 0.55 \times 57.97 / 4 \text{ [mm]}\\ &\approx 0.55 \times 57.97 / 4 \text{ [mm]}\\ &\approx 8 \text{ [mm]}\end{aligned}$$

where λ is set as λ=c/f (c: the speed of light, f: a frequency of a signal to be eliminated), f is set as f=2.5 GHz, Kc is set as Kc=0.55, and ∈r is set as ∈r=4.3.

Thus, in the above case, setting L3 as L3≈8 mm appropriately eliminates spurious signals (unnecessary signals) with a frequency of approximately 2.5 GHz. In other words, the pattern antenna 2000 appropriately reduces the antenna sensitivity to the spurious signals (unnecessary signals) with a frequency of approximately 2.5 GHz.

Incidentally, the capacitance contribution rate Kc is determined depending on (1) a specific dielectric constant of a substance disposed between the conductor pattern of the antenna element portion 2 and the conductor pattern of the protruding portion 3D in the area where the conductor pattern of the antenna element portion 2 overlaps with the conductor pattern of the protruding portion 3D as viewed in planar view, and/or (2) the size of the area or the like where the conductor pattern of the antenna element portion 2 overlaps with the conductor pattern of the protruding portion 3D as viewed in planar view.

In other words, once the structure of a pattern antenna is determined, the capacitance contribution ratio Kc can be determined accordingly. Thus, the shape of the protruding portion (e.g., the length L3) can be determined based on the determined capacitance contribution ratio Kc, as described above.

The length L3 of the protruding portion 3D as shown in FIG. 6 may be determined as described above.

An antenna including the antenna element portion 2 with a complicated shape, such as the pattern antenna 1000 of the first embodiment and the pattern antenna 2000 of the second embodiment, tends to have multi-band characteristics. For example, the antenna characteristics of the pattern antenna 1000A in FIG. 4 shows that the standing wave ratio at 2.5 GHz is also small while the standing wave ratio at 925 MHz, which is a frequency of a signal used in the pattern antenna, is small. This means that the pattern antenna has good antenna characteristics for a signal (electromagnetic wave) with a frequency of 2.5 GHz other than 925 MHz. In other words, the pattern antenna 1000A has good antenna characteristics that allow both of a signal with a frequency of 925 MHz and a signal with a frequency of 2.5 GHz to be transmitted and received efficiently. However, in designing to use only a signal with a frequency of 925 MHz, the signal with a frequency of 2.5 GHz is spurious (unnecessary) signal, thus requiring the antenna characteristics to be improved at frequencies around 2.5 GHz (requiring signals with frequencies around 2.5 GHz not to be transmitted and received).

In view of this, a protruding portion 3D is provided in the pattern antenna 2000 of the present embodiment, as shown in FIG. 6. This structure changes the input impedance around frequencies of spurious (unnecessary) signals and lowers the antenna sensitivity for transmitting and/or receiving the spurious signals when the antenna pattern has multi-band characteristics.

This enables the pattern antenna 2000 of the present embodiment to have good antenna characteristics in frequencies at and around the frequency of the signal to be transmitted and/or received in the pattern antenna 2000, thus allowing only necessary signals to be transmitted and/or received in the pattern antenna 2000.

Figure 7:
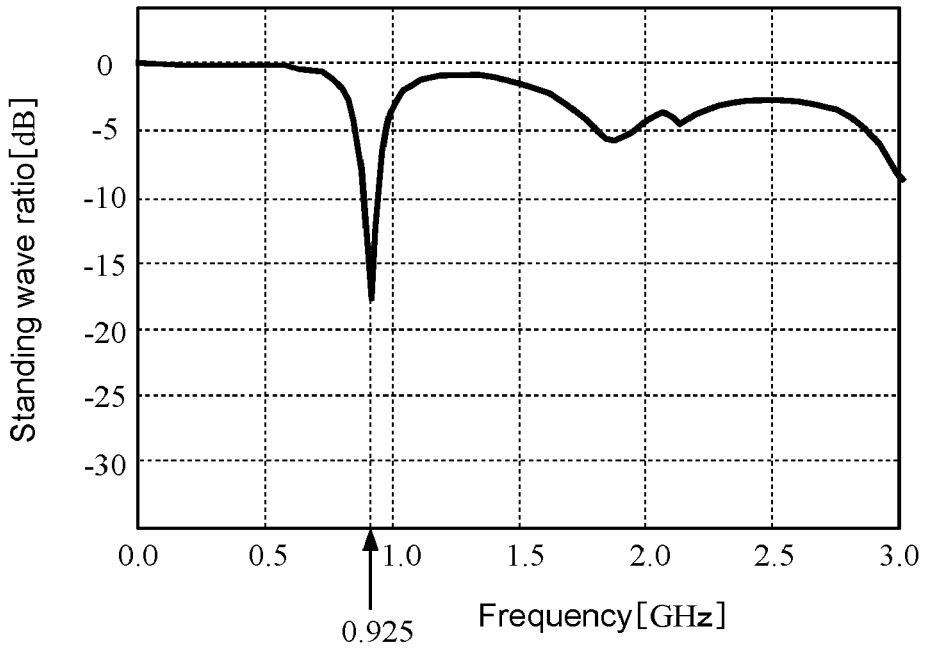
FIG. 7 is a diagram showing antenna characteristics of the antenna pattern 2000 according to the second embodiment (an example).
Figure 7:
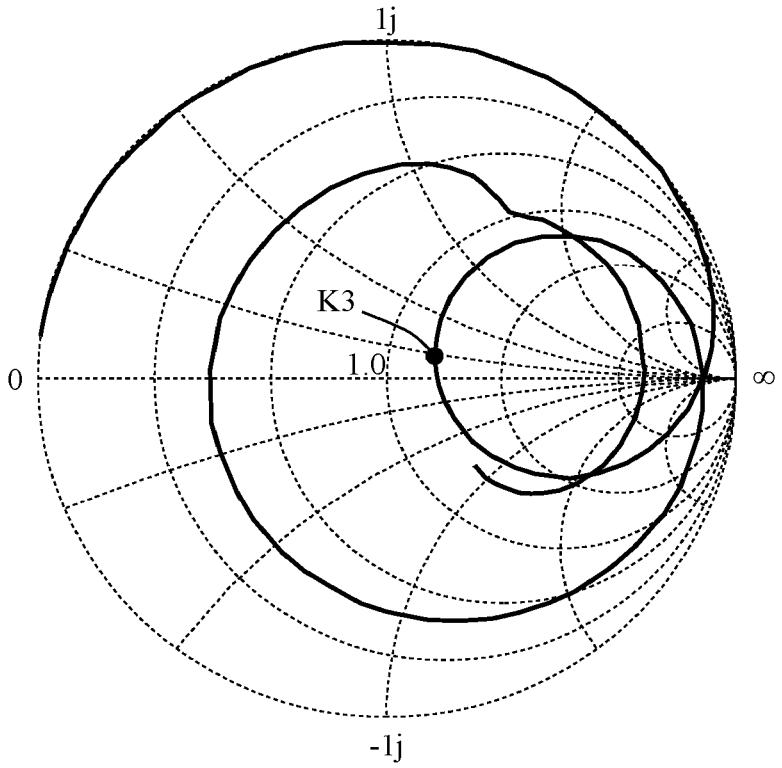

FIG. 7 is a diagram showing antenna characteristics of the antenna pattern 2000 according to the present embodiment (an example). More specifically, FIG. 7 shows the frequency-standing wave ratio characteristics of the pattern antenna 2000 (the upper portion of FIG. 7), which additionally includes the protruding portion 3D as compared with the pattern antenna 1000B with antenna characteristics shown in FIG. 5, and the Smith chart of input impedance of the pattern antenna 2000 (the lower portion of FIG. 7).

As shown in the diagram showing the frequency-standing wave ratio characteristics in FIG. 7 (the upper portion of FIG. 7), the pattern antenna 2000 has a frequency-standing wave ratio of −17.9 dB at 925 MHz.

Point K3 depicted in the Smith chart of the input impedance in FIG. 7 (the lower portion of FIG. 7) indicates the input impedance of the pattern antenna 2000 at 925 MHz. More specifically, the input impedance Z of the pattern antenna 2000 at 925 MHz is expressed in complex representation as follows:

$$Z=63.6+j\times 5.0$$

where "j" is the imaginary unit. The input impedance of the pattern antenna 2000 (the absolute value of Z) is 63.8Ω.

In the pattern antenna 2000, for example, a circuit for impedance matching is provided between the feed point 31C of the short-circuiting portion 3C and the ground portion 1, and is adjusted such that the impedance Z=63.6+j×5.0 is closer to 50Ω (that is, Z=50) at 925 MHz, thereby enabling the input impedance of the pattern antenna 2000 to be closer to 50Ω.

As shown in FIG. 7, the frequency-standing wave ratio characteristics of the pattern antenna 2000 (the upper portion of FIG. 7) has no peak around 2.5 GHz, which exists in the frequency-standing wave ratio characteristics of the pattern antenna 1000B shown in the upper portion of FIG. 5. This means that the pattern antenna 2000 has no multi-band characteristics. In other words, providing the protruding portion 3D in the pattern antenna 2000 changes the input impedance around 2.5 GHz, and prevents signals with frequencies around 2.5 GHz from transmitting and receiving, thus improving the characteristics.

Furthermore, providing the protruding portion 3D in the pattern antenna 2000 enhances the capacitance, thereby improving the input impedance of the pattern antenna 2000 around 925 MHz; that is, the imaginary component of the input impedance is small as compared with the case of FIG. 5.

This allows the input impedance of the pattern antenna 2000 to be closer to 50Ω as compared with the pattern antenna of the first embodiment. This more efficiently reduces the circuit scale of an antenna circuit connected to the pattern antenna to adjust the input impedance to be closer to 50Ω.

The principle that providing the protruding portion 3D in the pattern antenna 2000 prevents spurious signals from being transmitted and received (lowers the antenna sensitivity for transmitting and/or receiving spurious signals) will now be described with reference to FIG. 8.

Figure 8:
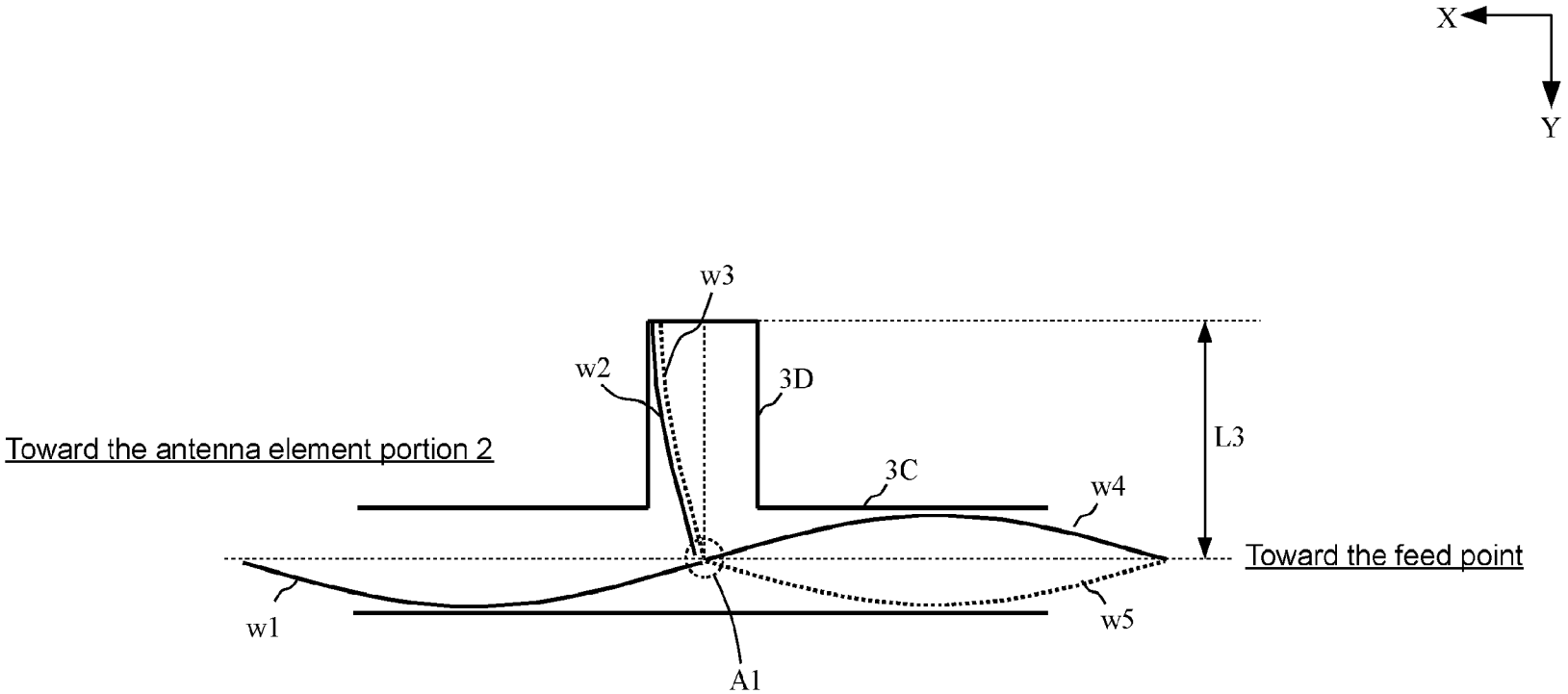
FIG. 8 is a schematic diagram illustrating a short-circuiting portion 3C and a protruding portion 3D of the pattern antenna 2000, and signal waves w1 to w5 having a spurious frequency.

FIG. 8 is a schematic diagram illustrating a short-circuiting portion 3C and a protruding portion 3D of the pattern antenna 2000, and signal waves w1 to w5 corresponding to a spurious frequency.

As shown in FIG. 8, a signal wave w1 with a spurious frequency transmitted from the antenna element portion 2 propagates, via the point A1 shown in FIG. 8, toward the protruding portion 3D and the feed point.

Here, L3=λ1/4 is assumed to be satisfied, where L3 is a distance in the Y-axis direction from the point A1 to the tip of the protruding portion 3D, and λ1 is the wavelength of a signal wave with a spurious frequency.

A signal wave w2 with the spurious frequency that propagates from the point A1 toward protruding portion 3D reflects at the tip of the protruding portion 3D. The protruding portion 3D is an open stub. Thus, the signal wave w2 totally reflects at an open end; that is, the signal wave w2 reflects without changing its phase (with a phase difference of zero) and then propagates toward the point A1 as a reflected wave w3.

The reflected wave w3 that has reached the point A1 propagates, from the point A1, toward the antenna element portion 2 and the feed point as a signal wave w5.

The signal wave w5 has traveled back and forth between the point A1 and the tip of the protruding portion 3D; that is, it has traveled a distance of 2×λ1/4. This causes the phase of the signal wave w5 to shift by π as compared with that of the signal w4 corresponding to the signal wave w1 that propagates directly toward the feed point. In other words, the signal waves w4 and w5 are opposite in phase, and thus the signal components of the both are canceled. As a result, no signals with spurious frequencies propagate toward the feed point.

As described above, in the pattern antenna 2000, the distance from the center in the width direction of the short-circuiting portion 3C to the tip of the protruding portion 3D is set to be a quarter of the wavelength of the spurious signal, thereby preventing the spurious signal from propagating toward the feed point of the pattern antenna 2000.

Thus, providing the protruding portion 3D as described above in the pattern antenna 2000 lowers the antenna sensitivity for transmitting and/or receiving spurious frequency components, thereby improving the antenna characteristics of the pattern antenna 2000.

Furthermore, the antenna sensitivity to electromagnetic waves to be excluded in the pattern antenna 2000 may be reduced in consideration of the wavelength shortening effect.

The wavelength shortening effect is an effect in which the wavelength of a high-frequency signal passing through a conductor portion shortens depending on a specific dielectric constant of material located around the conductor portion through which the signal passes. The wavelength λ0 in consideration of the wavelength shortening effect is calculated as λ0=λ/sqrt(∈r), where ∈r is a specific dielectric constant of material located around the conductor portion through which the signal passes.

Furthermore, the antenna sensitivity to electromagnetic waves to be excluded may be reduced in consideration of the capacitance contribution rate Kc (0≤Kc≤1) caused by overlapping of the conductor pattern of the antenna element portion 2 with the conductor pattern of the protruding portion 3D.

Figure 9:
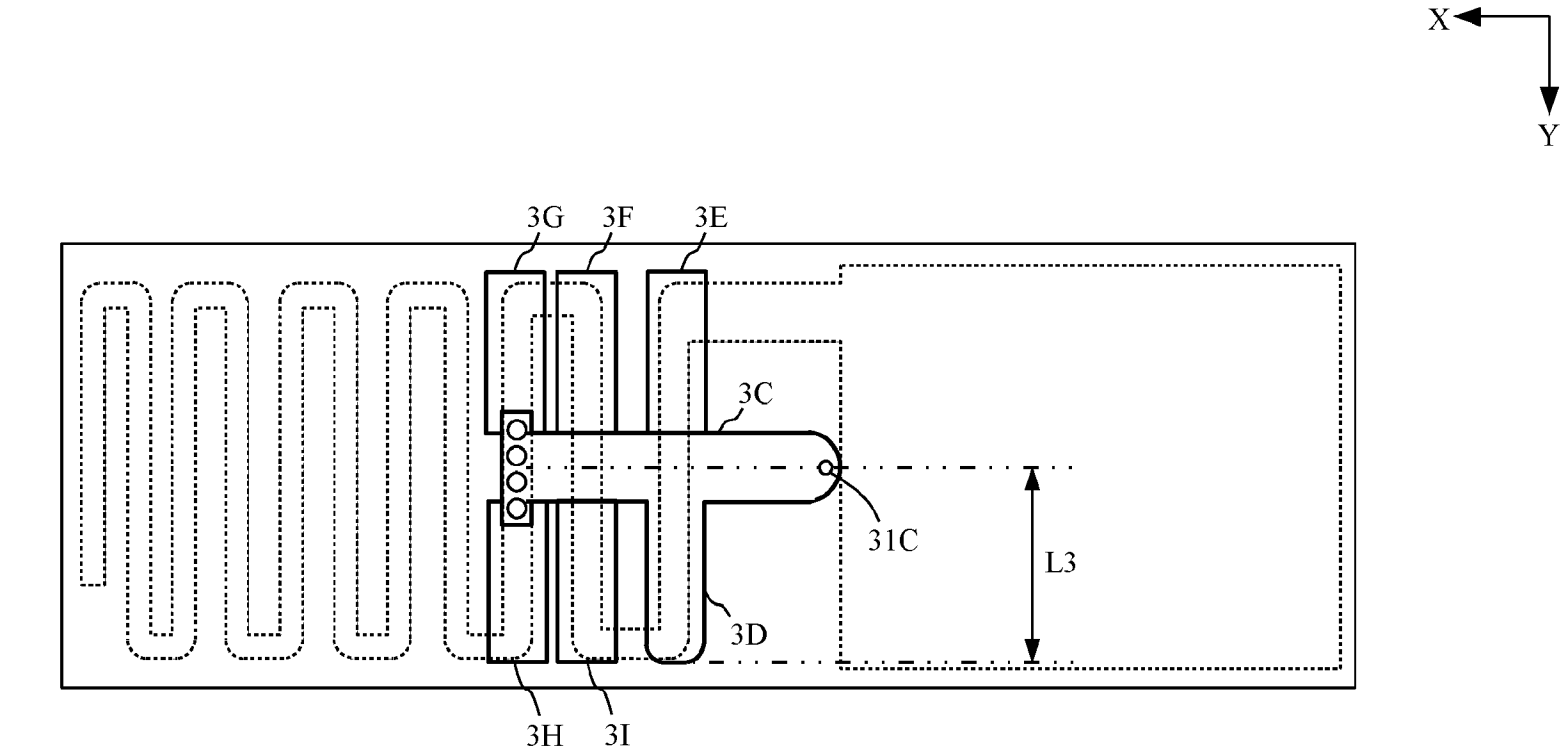
FIG. 9 is a schematic diagram describing the location of the protruding portion of the pattern antenna 2000.
Figure 10:
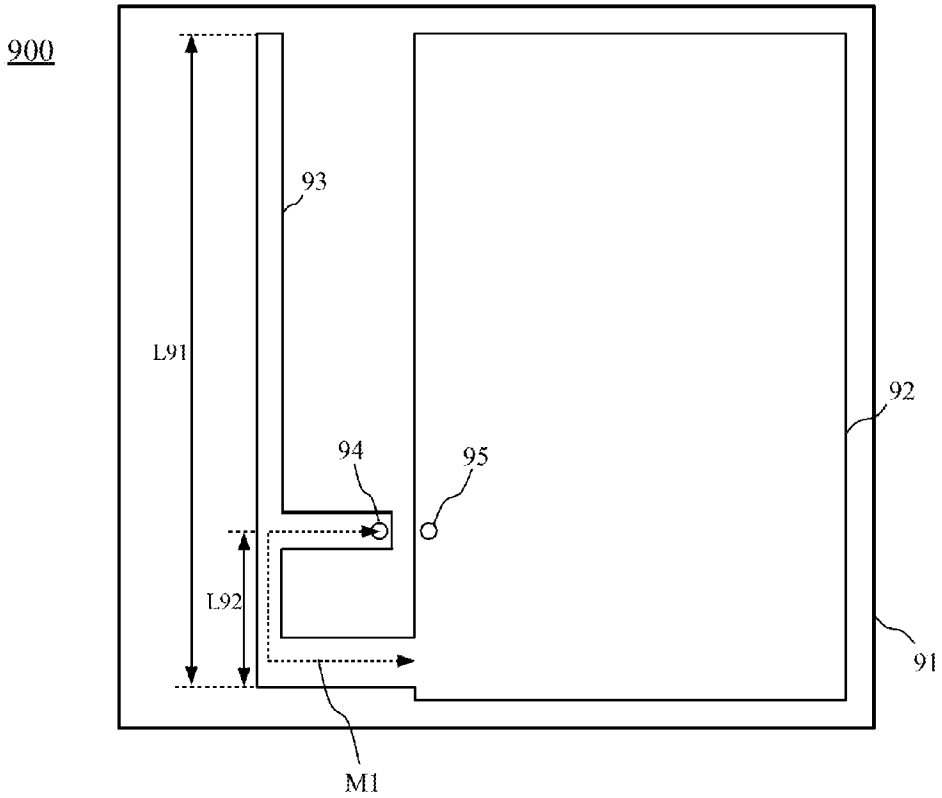
FIG. 10 BACKGROUND ART
FIG. 10 is a schematic diagram showing a conventional F-shaped pattern antenna 900 (one example).

Also, the protruding portion 3D of the pattern antenna 2000 may be disposed at positions other than the one described in the above. For example, the protruding portion may be formed at any position of 3F to 3I shown in FIG. 9 so as to extend from the short-circuiting portion 3C. Also, two or more protruding portion may be formed at any two or more positions of 3D to 3I shown in FIG. 9

Furthermore, the protruding portions may be formed to extend in any direction (e.g., oblique direction) from the short-circuiting portion 3C.

In any cases described above, the distance from the center in the width direction (Y-axis direction) of the short-circuiting portion 3C to the tip of the protruding portion extending toward any direction is set to be approximately a quarter of the wavelength of a signal to be prevented from transmitting and/or receiving (to be excluded), thereby efficiently eliminating the signal component (signal component of the spurious signal).

As described above, providing the protruding portion 3D extending from the short-circuiting portion 3C in the pattern antenna 2000 efficiently eliminates spurious signals, thus improving the antenna characteristics. The structure of the pattern antenna enhances capacitance (capacitance component), thus allowing the input impedance to be closer to a desired value. This reduces the circuit scale required for the impedance adjustment in the pattern antenna 2000.

Furthermore, to adjust the input impedance of the pattern antenna 2000, the specific dielectric constant between the first surfaces of the substrate B (the surface on which the ground portion 1 and the antenna element portion 2 are formed) and the second surface of the substrate B (the surface on which the short-circuiting portion 3C and the protruding portion 3D (3E to 3I) are formed) may be adjusted to be closer to a predetermined value, and furthermore the positional relationship, shapes as viewed in planar view, or the like of the antenna element portion 2 and the short-circuiting portion 3 may be adjusted in a manner similar to the above.

The specific structures described in the above embodiments are mere examples of the present invention, and may be changed and modified variously without departing from the scope and the spirit of the invention.

REFERENCE SIGNS LIST

1000,1000A, 1000B, 2000 pattern antenna
1 ground portion
2 antenna element portion
3,3A, 3B, 3C short-circuiting portion
3D, 3E, 3F, 3G, 3H, 3I protruding portion
31,31A, 31B, 31C feed point

The invention claimed is:

1. A pattern antenna comprising:

a substrate;

a ground portion formed on a first surface of the substrate;

an antenna element portion including a conductor pattern in which a plurality of bent portions are formed, the conductor pattern being formed on the first surface of the substrate and being electrically connected to the ground portion;

a short-circuiting portion including a conductor pattern formed in a second surface, which is a different surface from the first surface, the conductor pattern being formed so as to at least partially overlap with the conductor pattern of the antenna element portion as viewed in planar view;

a connecting portion configured to electrically connect the conductor pattern of the antenna element portion to the conductor pattern of the short-circuiting portion; and a protruding portion electrically connected to the short-circuiting portion on the second surface of the substrate, the protruding portion including a conductor pattern formed so as to at least partially overlap with the conductor pattern of the antenna element portion that is disposed between the connecting portion and the ground portion as viewed in planar view.

2. The pattern antenna according to claim 1, wherein the antenna element portion includes the conductor pattern formed in a meander line shape.

3. The pattern antenna according to claim 1, wherein the short-circuiting portion and the protruding portion are each formed in a rectangular shape, and the protruding portion is formed such that a distance from a center line in the longitudinal direction of the short-circuiting portion to the tip of the protruding portion as viewed in planar view is a length satisfying $\lambda/4\pm0.3\times(\lambda/4)$ where $\lambda$ is a wavelength of an electromagnetic wave to be eliminated in the pattern antenna.

4. The pattern antenna according to claim 1, wherein the short-circuiting portion and the protruding portion are each formed in a rectangular shape, and the protruding portion is formed such that a distance from a center line in the longitudinal direction of the short-circuiting portion to the tip of the protruding portion as viewed in planar view is a length L1 satisfying $\lambda0=\lambda/\mathrm{sqrt}(\in r)$ and $L1=\lambda0/4\pm0.3\times(\lambda0/4)$ where $\lambda$ is a wavelength of an electromagnetic wave to be eliminated in the pattern antenna, $\in r$ is a specific dielectric constant of the substrate, and sqrt(x) is a function that returns the square root of x.

5. The pattern antenna according to claim 1, wherein the short-circuiting portion and the protruding portion are each formed in a rectangular shape, and the protruding portion is formed such that a distance from a center line in the longitudinal direction of the short-circuiting portion to the tip of the protruding portion as viewed in planar view is a length L2 satisfying $\lambda0=\lambda/\mathrm{sqrt}(\in r)$ and $L2=Kc\times\lambda0/4\pm0.3\times Kc\times(\lambda0/4)$ where $\lambda$ is a wavelength of an electromagnetic wave to be eliminated in the pattern antenna, $\in r$ is a specific dielectric constant of the substrate, Kc ($0\leq Kc\leq1$) is a capacitance contribution rate caused by overlapping of the conductor pattern of the antenna element portion with the conductor pattern of the protruding portion as viewed in planar view, and sqrt(x) is a function that returns the square root of x.

6. The pattern antenna according to claim 1, wherein the protruding portion includes a plurality of portions formed on the second surface of the substrate, each of which does not overlap with the others.

* * * * *